US006105637A

United States Patent [19]

VerMehren

[11] Patent Number: 6,105,637

[45] **Date of Patent: *Aug. 22, 2000**

[54] SYSTEM FOR PACKAGING GRANULAR MATERIALS

[76] Inventor: H. Richard VerMehren, 3865 N. Palafox St., Pensacola, Fla. 32505

[ * ] Notice: This patent is subject to a terminal disclaimer.

[21] Appl. No.: 09/282,856

[22] Filed: Mar. 31, 1999

[51] Int. Cl.[7] ..... B65B 1/06

[52] U.S. Cl. ..... 141/248; 141/129; 53/168

[58] Field of Search ..... 141/129.1, 169, 141/170, 248; 53/168

[56] References Cited

U.S. PATENT DOCUMENTS

| | | | |
|---|---|---|---|
| 2,602,576 | 7/1952 | Spruck | 141/248 |
| 5,010,929 | 4/1991 | Tisma | 141/1 |
| 5,651,401 | 7/1997 | Cados | 141/129 |
| 5,752,367 | 5/1998 | VerMehren | 53/473 |

*Primary Examiner*—J. Casimer Jacyna
*Attorney, Agent, or Firm*—Thomas, Kayden, Horstemeyer & Risley

[57] ABSTRACT

A fill hopper assembly (30) includes two fill hoppers (50) and (52) which are reciprocated back and forth beneath a feed hopper (14) and over discharge openings (72 and 74) of a discharge bridge plate (32). The upper fill hopper bridge plate (34) includes an intermediate bridge (48) that closes the hopper extension (28) when the fill hopper assembly is in transition to place one of its fill openings (36 or 38) beneath the feed hopper extension (28). The fill hopper bridge (48) closes the fill hopper extension until one of the fill openings (36 or 38) is in registration with the extension (28). Likewise, the discharge bridge plate (32) includes a bridge (76) that closes the bottom openings of the open-ended fill hoppers (50 and 52) when the fill hoppers are centered and as they approach their laterally displaced discharge openings (72 or 74).

8 Claims, 2 Drawing Sheets

SYSTEM FOR PACKAGING GRANULAR MATERIALS

FIELD OF THE INVENTION

This invention relates in general to packaging machinery for packaging granular material. The system receives material from a feed hopper of an auger conveyor or other delivery device and feeds the material to movable hoppers that alternately collect the material and move the material laterally to deliver the material to containers.

BACKGROUND OF THE INVENTION

Packaging machines have been developed for handling dry granular materials, such as sand, gravel, fertilizer, sugar, beans, grains, and other flowable foodstuffs. It is common practice to pack the materials in hard surface containers or in cloth, paper, or plastic sacks, with the granular materials being loaded through the open end of the sack, etc., with the open end of the sack later being stitched, glued, or otherwise sealed shut.

My prior U.S. Pat. No. 5,752,367 discloses an automated apparatus for packaging generally granular materials, which includes two or more fill hoppers which are alternately positioned beneath a central feed hopper and which move laterally to a delivery position to discharge the materials received therein. This system includes a gravity actuated trap door carried by each fill hopper which is opened in response to the fill hopper reaching the discharge position, to allow the material to flow from the fill hopper to the receiving sack or other container. While my foregoing system is successful in delivering most flowable solid materials, the system does not function as well when handling fine grain particles, such as fine sand or other granular materials of the size and shape of fine sand. In some instances, particularly when the material is wet, the function of the trap doors of such a system can be impeded by the wet material. In some instances the material is not properly discharged from the fill hoppers and some of the material clings to and accumulates between the trap doors and the bottom edge of the reciprocating fill hopper.

Thus, there is a need for an improved system for reliably and expediently loading containers with flowable granular materials that is less subject to the flowable material accumulating between the parts of the dispensing apparatus and impeding the dispensing function of the system.

SUMMARY OF THE INVENTION

The present invention provides an improved system for dispensing flowable granular materials to containers which overcome some of the design deficiencies of the known prior art. The system collects material from a feed hopper which typically is supplied with flowable granular material from an auger conveyor or some other conveying system on a continuous or intermediate basis. At least two vertically open ended fill hoppers move on a fill hopper bridge plate which blocks the lower openings of the fill hoppers and the fill hoppers are alternately positioned centrally beneath the centrally positioned supply hopper to receive the oncoming granular material through the upper openings of the fill hoppers. When a fill hopper has received its load of material from the feed hopper it is moved laterally from the feed hopper over the bridge plate into registration with a lower discharge opening and it drops its load of flowable granular material through the discharge opening into a container positioned therebelow. In the meantime, another fill hopper is moved into registration with the centrally positioned feed hopper to begin receiving its load of material. Typically, the containers to be filled by the system would be carried by a conveyor system, so that once a container is filled with the flowable granular material at the end of a cycle of operation of the system, the filled container can be advanced away from the system and an empty oncoming container can be moved into registration with the discharge of the system.

DETAILED DESCRIPTION OF THE INVENTION

Figure 1:
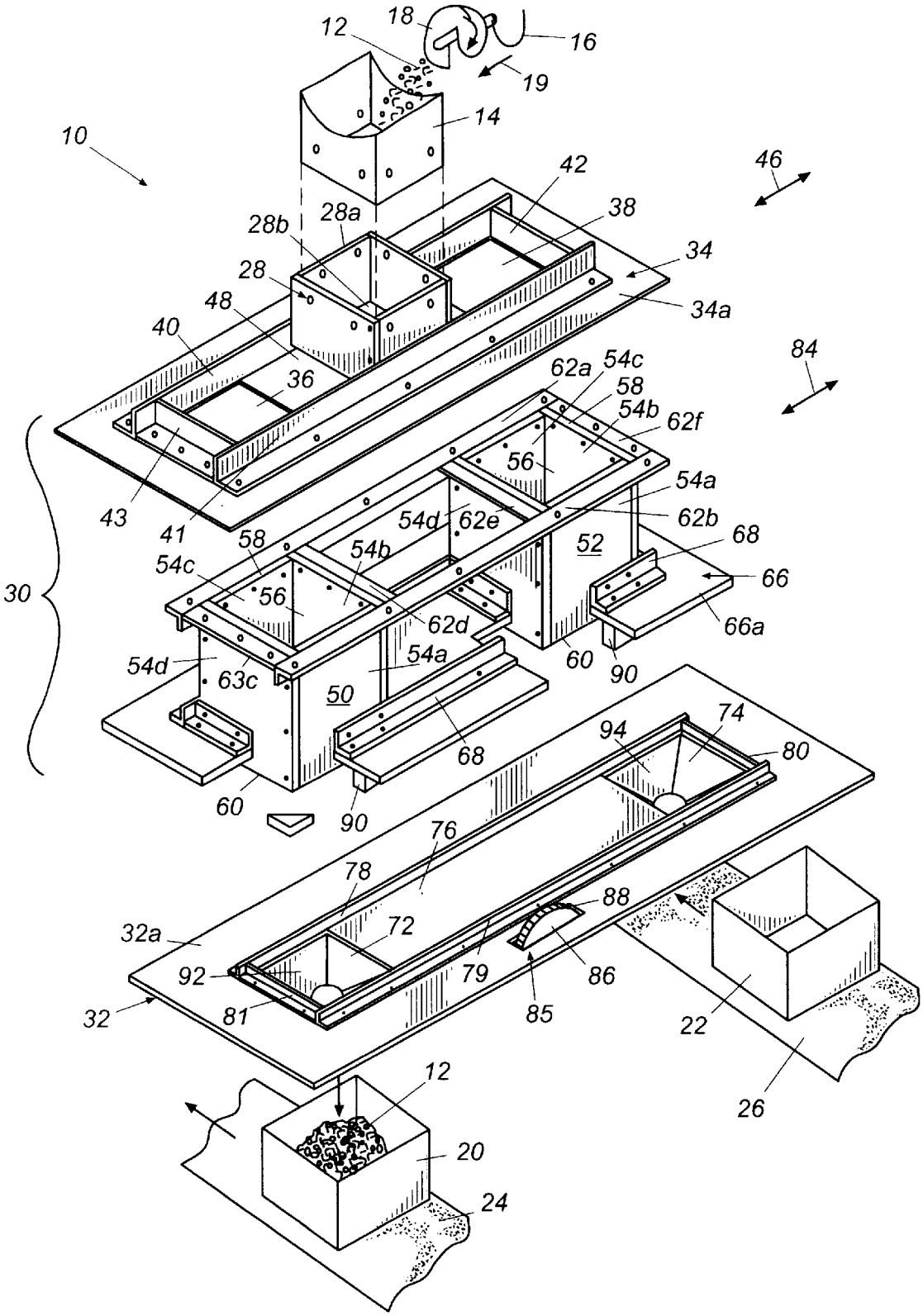
FIG. 1 is an expanded perspective illustration of the apparatus for packaging granular materials, with some portions broken away for clarity.

Referring now in more detail to the drawings, in which like numerals indicate like parts throughout the several views, the system for packaging granular materials is in the form of an apparatus and a method for achieving the end of packaging materials in containers.

As shown in the drawings, the dispensing apparatus 10 receives granular flowable bulk material 12 from a hopper 14 that is located at the discharge end of a conveyor system such as an auger conveyor 16 that rotates in the direction indicated by arrow 18 to move the material in the direction of arrow 19 into the feed hopper 14. While auger conveyor 18 is illustrated with a conventional feed hopper 14, various other shapes, sizes and structures of hoppers 14 can be utilized, with the hoppers being loaded in various manners, not necessarily by an auger conveyor. The system is arranged to discharge the bulk material 12 to open top containers, such as boxes 20 and 22, that are moved along parallel paths on surface conveyors 24 and 26, respectively, beneath the apparatus.

The dispensing apparatus 10 includes the hopper extension 28 for extending the hopper of the feed hopper 14, the fill hopper assembly 30 positioned below the feed hopper extension, and the discharge bridge plate 32 positioned beneath the fill hopper assembly 30 and over the surface conveyors 24 and 26.

Feed hopper extension 28 is constructed so as to be telescopically fitted about the lower end portion of the feed hopper 14 of the auger conveyor 16, so as to be able to adjust the distance between the feed hopper 14 and the dispensing apparatus. Typically, set screws, bolts, or other conventional connectors are utilized to rigidly suspend the feed hopper extension 28 on the feed hopper 14, so that the feed hopper extension 28 does not physically engage the fill hopper assembly 30.

Fill hopper assembly 30 includes fill hopper bridge plate 34 which, in the embodiment disclosed herein, comprises a rectangular plate with fill openings 36 and 38 formed therein and laterally displaced from each other. Side barriers 40 and 41 and end barriers 42 and 43 are mounted to the upper surface 34*a* of the fill hopper bridge plate. The barriers 40–43 are angle irons which are L-shaped in cross-section, with each barrier including a horizontal flange mounted rigidly to the upper surface 34*a* of the bridge plate 34 and an upright flange which extends upwardly and which is approximately co-extensive with the adjacent edge of the fill openings 36 and 38. The fill hopper bridge plate 34 is arranged to reciprocate as indicated by direction arrows 46, so that the fill openings 36 and 38 will alternately register with the feed hopper extension 28, allowing the granular, flowable bulk material 12 to flow vertically through the feed hopper extension 14 through the fill openings 36 and 38.

It will be noted that fill hopper bridge plate 34 includes an intermediate segment 48 that passes beneath the feed hopper extension 28, which closes the lower opening 28*b* of the feed hopper extension 28 during the transition of the registration of the fill openings 36 and 38 with the feed hopper extension. This substantially closes the lower opening 28*b* and terminates the flow of granular bulk material 12 through the vertically open ended feed hopper extension 28 until one of the fill openings 36 or 38 registers with the feed hopper extension 28. In the meantime, the side barriers 40 and 41 and end barriers 42 and 43 retard the spillage of the granular bulk material from the fill hopper bridge plate 34.

Fill hopper 30 also includes a pair of laterally displaced fill hoppers 50 and 52 which are spaced apart a distance corresponding to the spacing between fill openings 36 and 38 so as to be aligned with the fill openings. Fill hoppers 50 and 52 are each vertically open ended, and each are formed by metal plates 54*a*, 54*b*, 54*c*, and 54*d*, with each defining a vertical passage 56 extending therethrough. The vertical walls 54*a–c* form an upper edge 58 and a lower edge 60. The vertical flanges of angle irons 62*a* and 62*b* are attached to opposite sides of the fill hoppers at the upper edges 58 of the fill hoppers, while the vertical flanges of angle irons 62*c*, 62*d*, 62*e* and 62*f* are attached to the other sides of the fill hoppers 50, and abut at their ends against angle irons 62*a* and 62*b*. The horizontal flanges of all the angle irons 62*a*–62*f* are positioned at approximately the same level as the upper edge 58 of both fill hoppers 50, 52 with the vertical flanges of the angle irons being connected directly to the wall sections of the fill hoppers 50, 52. Also, the horizontal sections of the angle irons are connected to the fill hopper bridge plate 34, so that the fill hoppers 50, 52 are rigidly connected to and move in unison with the fill hopper bridge plate 34.

Figure 2:
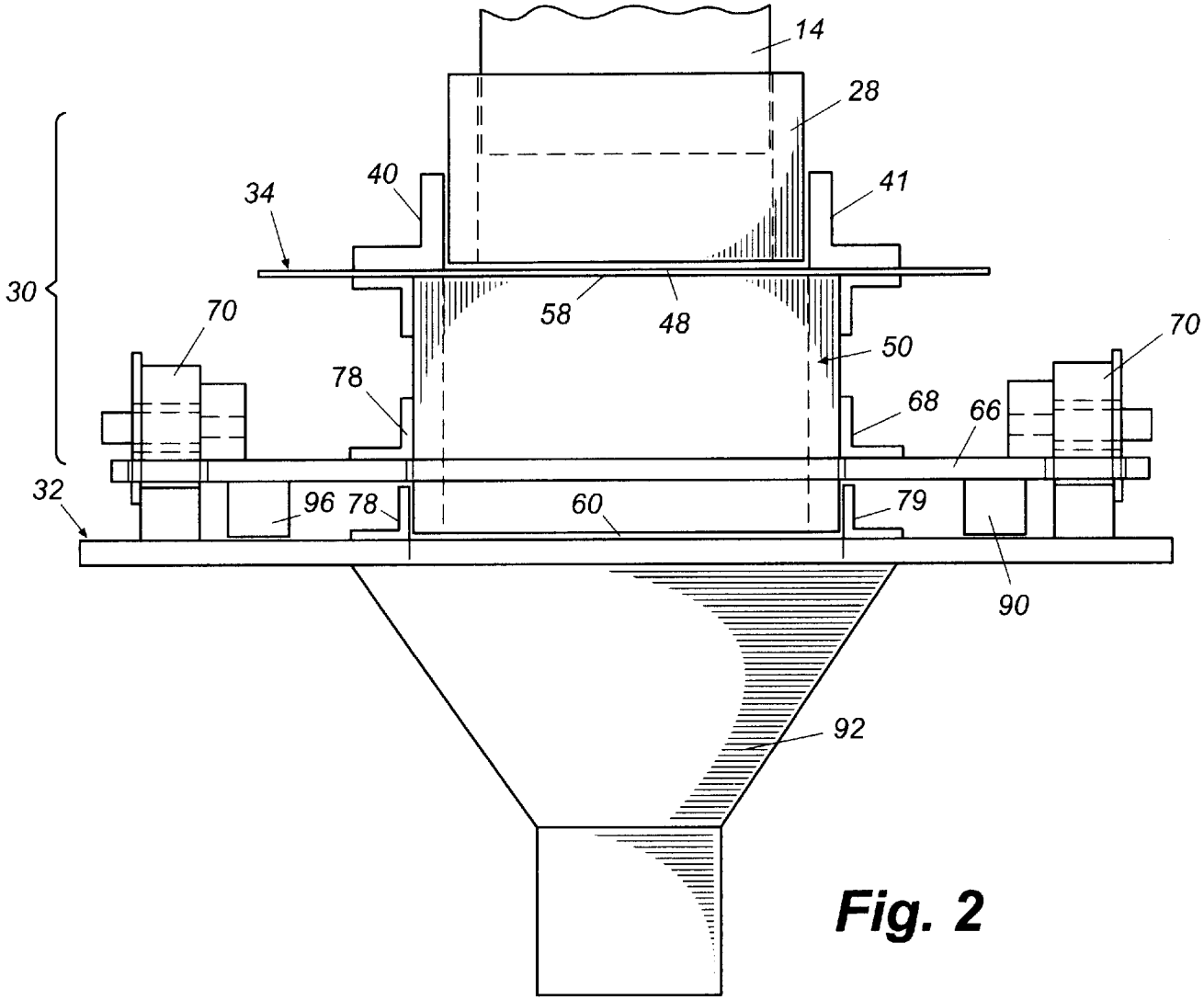
FIG. 2 is an end view of the apparatus.

A fill hopper support plate 66 is mounted to the fill hoppers 50, 52 with additional angle irons 68, with the fill hopper support plate defining openings that receive the fill hoppers 50 and 52. The fill hopper support plate 66 is displaced upwardly from the lower edges 60 of the fill hoppers, and support wheels 70 are mounted to the top surface 66*a* of the fill hopper support plate 66, and are arranged to engage a support rail 71 (shown in FIG. 2) mounted on discharge bridge plate 32 to support the lower edges 60 of the fill hoppers in juxtaposition with respect to the upper surface 32*a* of the discharge bridge plate 32. The support wheels and rail are disclosed in more detail in my U.S. Pat. No. 5,752,367.

Discharge bridge plate 32 is rectangular and defines discharge openings 72 and 74 which are laterally spaced from each other a distance that corresponds to twice the lateral spacing of fill openings 36 and 38 of fill hopper bridge plate 34 and of the fill hoppers 50 and 52. Also, the discharge openings 72 and 74 are sized and shaped to correspond to the size and shape of fill hoppers 50 and 52, assuring that the material to be dispensed from the fill hoppers can flow freely through the open bottom of the fill hopper through the discharge openings 72 and 74.

An intermediate segment 76 of the discharge bridge plate 32 extends between discharge openings 72 and 74 and functions as a bridge to close the bottom openings of the fill hoppers when the fill hoppers are between the discharge openings 72 and 74. Side barriers 78 and 79 and end barriers 80 and 81 are rigidly mounted to the upper surface 32*a* of discharge bridge plate 32, surrounding the discharge openings 72 and 74 and the intermediate segment 76. The side barriers retard the spillage of the granular bulk material being dispensed by the system.

The barriers 78–81 which are mounted on the discharge bridge plate 32 are adapted to retard spillage of material from the discharge bridge plate, as will be explained in more detail hereinafter.

The fill hoppers 50 and 52 are of a width that is less than the width between side barriers 78 and 79, so that the fill hoppers are located between the side barriers, with the side barriers straddling the lower edges 60 of the fill hoppers. Support wheels 70 and their rails 71 are spaced from the fill hoppers 50 and the side barriers 78 and 79 so that the support wheels and rails straddle the side barriers 78 and 79.

A reversible drive system is used to reciprocate the fill hopper assembly 30 as indicated by double-headed arrow 84 with respect to the stationary discharge bridge plate 32. The drive system 85 includes a reversible motor (not shown) mounted to the bottom of discharge bridge plate 32, which rotates drive wheel 86 (FIG. 1). Drive wheel 86 protrudes upwardly through slot 88 in discharge bridge plate 32 and engages downwardly facing drive rack 90 that is mounted to the bottom surface of fill hopper support plate 66. Thus, when drive wheel 86 is rotated, the fill hopper assembly 30 will move longitudinally along discharge bridge plate 32. The reversible drive system is disclosed in more detail in my prior U.S. Pat. No. 5,752,367.

It will be noted that the spacing of the fill hoppers 50 and 52 is approximately one-half the spacing between discharge openings 72 and 74 of discharge bridge plate 32. Therefore, when one of the fill hoppers 50 or 52 is in registration with one of the discharge openings 72 or 74, the other fill hopper 52 or 50 will be located intermediate the discharge openings 72 and 74. With this arrangement, the intermediate segment 76 of the discharge bridge plate functions as a discharge bridge which closes the lower edge 60 of the fill hopper, so as to retain in the fill hopper any material that has been received in the fill hopper.

In the meantime, when one of the fill hoppers 50 or 52 is in registration with a discharge opening 72 or 74, the other fill hopper and its fill opening 36, 38 will be centered beneath the feed hopper extension 28, so that the material in the feed hopper 14 and the oncoming material from the auger conveyor 16 can be immediately fed by gravity into the centered fill hopper.

When the material from the fill hopper 50 or 52 which is in registration with a discharge opening 72 or 74 has dispensed its load to an awaiting open-top container 20 or 22, and when the centered fill hopper has received a new load to be dispensed, the drive system 85 will reverse and move the fill hoppers laterally until the recently filled hopper registers with a discharge opening 72 or 74 and the recently emptied fill hopper becomes centered beneath the feed hopper extension 28. With this arrangement, the intermediate segment 76 of the discharge bridge plate 32 becomes a discharge bridge which closes the bottom opening of the fill hoppers 50 and 52 when they are in their centered positions and as they move progressively from their centered positions over to a discharge opening 72 or 74.

Discharge funnels 92 and 94 are positioned beneath each discharge opening 72 and 74, so as to guide the material to an awaiting open-top container 20 or 22.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. Apparatus for dispensing flowable granular materials received from a feed hopper for packaging into containers, comprising:

a fill hopper assembly for positioning below a feed hopper, said fill hopper assembly including:

a pair of open ended fill hoppers laterally spaced from each other sized and shaped to receive the material to be packaged from the feed hopper, said fill hoppers each having upper edges and lower edges and openings at their upper and lower edges for registering with the feed hopper and for passing material therethrough, a fill hopper bridge plate mounted at said upper edges of each of said fill hoppers and forming a continuous surface between said fill hoppers and movable in unison with said fill hoppers to place said fill hoppers alternately into and out of registration with the feed hopper and alternately into and out of discharge positions, and forming a bridge between said upper openings of said fill hoppers for closing the discharge opening of the feed hopper when said fill hoppers are out of registration with the feed hopper, a stationary discharge bridge positioned below said fill hopper assembly defining laterally displaced discharge openings at said discharge positions and forming a bridge between said discharge positions and maintaining said lower openings of said fill hoppers closed when not in registration with said discharge openings, and shifting means for alternately and laterally shifting said fill hopper assembly to place said fill hoppers alternately into a centrally located fill position in registration with the feed hopper and into registration with said pair of discharge positions displaced laterally on opposite sides of said centrally located fill position to register said lower openings of said fill hoppers with said discharge openings of said discharge plate.

2. The apparatus for dispensing flowable granular material of claim 1, further including:

a base plate supporting said fill hoppers, and wheel members arranged to movably support said base plate on said stationary discharge bridge.

3. The apparatus for dispensing flowable granular material of claim 1, further including:

wheel members supporting said fill hopper assembly on said stationary discharge bridge.

4. The apparatus for dispensing flowable granular material of claim 1, and further including:

discharge bridge side barriers mounted on said discharge bridge and positioned on opposite sides of said fill hopper adapted to retard spillage of material from said discharge bridge.

5. The apparatus for dispensing flowable granular material of claim 4, and further including:

fill bridge side barriers mounted on said fill bridge for positioning on opposite sides of a feed hopper and adapted to retard spillage of material from said fill bridge.

6. A method of filling containers with flowable granular material comprising:

moving at least two vertically open ended fill hoppers each with a bottom opening and a top opening along a path alternately between a fill position beneath a feed hopper and discharge positions laterally displaced on opposite sides of the fill position, filling one of the fill hoppers at the fill position and discharging the other fill hopper at a discharge position, moving the fill hopper that has been filled along the path across a discharge bridge from the fill position to a discharge position while moving the fill hopper that has been discharged from a discharge position to the fill position, as a fill hopper is being filled, and as a fill hopper that has been filled moves along the path from the fill position toward the discharge position, closing the bottom opening of the fill hopper with the discharge bridge to retain the material in the fill hopper, moving in unison with the fill hoppers a fill hopper bridge extending between the top openings of the fill hoppers, and closing the feed hopper with the fill hopper bridge as the fill hoppers move between the fill position and the discharge positions.

7. The method of claim 6 and further including the step of:

moving the bottom openings of the fill hoppers between discharge bridge side barriers mounted on the discharge bridge extending parallel to the path, and retarding spillage of the material from the discharge bridge with the discharge bridge side barriers.

8. The method of claim 6 and further including the step of:

moving side barriers mounted on the fill hopper bridge about the feed hopper as the fill hopper bridge moves beneath the feed hopper, and retarding spillage of the material from the fill hopper bridge with the fill hopper bridge side barriers.

* * * * *